US006991666B2

(12) United States Patent
Organ

(10) Patent No.: US 6,991,666 B2
(45) Date of Patent: Jan. 31, 2006

(54) COLLECTING CHAMBER FOR A VACUUM CLEANER

(75) Inventor: Stephen Paul Organ, Devizes (GB)

(73) Assignee: Dyson Limited, Wiltshire (GB)

( * ) Notice: Subject to any disclaimer, the term of this patent is extended or adjusted under 35 U.S.C. 154(b) by 134 days.

(21) Appl. No.: 10/468,676

(22) PCT Filed: Jan. 24, 2002

(86) PCT No.: PCT/GB02/00320

§ 371 (c)(1),
(2), (4) Date: Aug. 21, 2003

(87) PCT Pub. No.: WO02/067742

PCT Pub. Date: Sep. 6, 2002

(65) Prior Publication Data

US 2004/0074213 A1 Apr. 22, 2004

(30) Foreign Application Priority Data

Feb. 24, 2001 (EP) ..... 0104680
Apr. 12, 2001 (EP) ..... 0109390

(51) Int. Cl.
*B01D 45/18* (2006.01)

(52) U.S. Cl. ..... 55/429; 15/352; 15/353; 55/433; 55/DIG. 3

(58) Field of Classification Search ..... 55/428–433, 55/346–349, 337, 459.1, DIG. 3; 15/350–353; 95/271; D32/21, 22
See application file for complete search history.

(56) References Cited

U.S. PATENT DOCUMENTS 686,404 A * 11/1901 Hess ..... 55/433
1,035,892 A * 8/1912 Meehan ..... 55/392
1,440,033 A * 12/1922 Stevens et al. ..... 55/396
1,444,384 A * 2/1923 Patitz ..... 55/385.3
1,759,947 A * 5/1930 Lee ..... 55/439
1,979,873 A * 11/1934 Engstrom ..... 55/334
2,714,426 A * 8/1955 White ..... 55/305
2,943,698 A * 7/1960 Bishop ..... 55/337
3,132,932 A * 5/1964 Pauleret et al. ..... 55/376
3,816,983 A 6/1974 Sawada et al. ..... 55/357
4,199,334 A * 4/1980 Berkhoel ..... 55/304
4,297,114 A * 10/1981 Hutchins ..... 55/299
4,373,228 A * 2/1983 Dyson ..... 15/350
4,735,639 A * 4/1988 Johnstone ..... 55/302
5,090,976 A 2/1992 Dyson ..... 55/337
6,193,787 B1 * 2/2001 Dyson et al. ..... 95/271
6,406,505 B1 * 6/2002 Oh et al. ..... 55/337
6,482,252 B1 * 11/2002 Conrad et al. ..... 96/57
6,546,593 B2 * 4/2003 Oh et al. ..... 15/353

FOREIGN PATENT DOCUMENTS

EP 0 042 723 A2 12/1981
EP 1 023 864 A2 8/2000
WO 98/10691 A1 3/1998
WO 01/05291 A1 1/2001

* cited by examiner

*Primary Examiner*—Richard L. Chiesa
(74) *Attorney, Agent, or Firm*—Morrison & Foerster LLP

(57) ABSTRACT

A bagless vacuum cleaner includes a separating unit for separating dirt and dust from a dirt-laden airflow which is drawn in by the cleaner. The separating unit has a chamber with a collection area for collecting dirt and dust which is separated from the airflow. A base of the separating unit is movable between a closed position and an open position. The base may be released by a trigger and a linking mechanism. The releasing mechanism is operable to apply an opening force to the base to push the base open, thereby allowing a tightly fining seal to be fitted to the base.

24 Claims, 7 Drawing Sheets

COLLECTING CHAMBER FOR A VACUUM CLEANER

FIELD OF THE INVENTION

This invention relates to a collecting chamber for a bagless vacuum cleaner and to a vacuum cleaner which incorporates the collecting chamber.

BACKGROUND OF THE INVENTION

Vacuum cleaners which separate dirt and dust from an airflow without the use of a filter bag, so-called bagless vacuum cleaners, are becoming increasingly popular. Most bagless cleaners use cyclonic or centrifugal separation to spin dirt and dust from the airflow. By avoiding the use of a filter bag as the primary form of separation, it has been found possible to maintain a consistently high level of suction, even as the collecting chamber fills with dirt.

The principle of cyclonic separation in domestic vacuum cleaners is described in a number of publications including EP 0 042 723. In general, an airflow in which dirt and dust is entrained enters a first cyclonic separator via a tangential inlet which causes the airflow to follow a spiral or helical path within a collection chamber so that the dirt and dust is separated from the airflow. Relatively clean air passes out of the chamber whilst the separated dirt and dust is collected therein. In some applications, and as described in EP 0 042 723, the airflow is then passed to a second cyclone separator which is capable of separating finer dirt and dust than the upstream cyclone. The airflow is thereby cleaned to a greater degree so that, by the time the airflow exits the cyclonic separating apparatus, the airflow is almost completely free of dirt and dust particles.

While bagless vacuum cleaners are successful in maintaining a consistently high level of suction, the absence of a bag can make it difficult to dispose of the dirt and dust which is collected by the cleaner. When the separating chamber of a bagless cleaner becomes full, a user typically removes the collecting chamber from the chassis of the machine, carries the chamber to a dust bin or refuse sack and tips the chamber upside down. Often dirt and dust is densely packed inside the collecting chamber and it may be necessary for a user to manually dislodge the dirt by reaching into the chamber and pulling at the collected mass of dust and fibres, or to shake or bang the collecting chamber against the side of a dustbin. In some cases, this can cause a fair amount of mess.

Some solutions to this problem have been proposed. U.S. Pat. No. 5,090,976 describes the use of a disposable liner which can be fitted inside the cyclonic separating chamber. When the liner is full, the liner is lifted out of the chamber and disposed of. WO 98/10691 describes a cyclonic collection chamber where a bag is retained, in a collapsed state, in the base of the collection chamber. When the collection chamber is full, the base is unscrewed from the chamber so that the bag can extend downwardly from the base. Dirt and dust slides out of the collecting chamber into the bag and the bag can then be sealed and separated from the collecting chamber for disposal. Both of these solutions have a disadvantage in that they require a user to keep a supply of spare bases or liners, which adds to the cost of maintaining the machine.

EP 1 023 864 describes a dust-collecting device for a cyclonic vacuum cleaner. The dust-collecting chamber can be removed from the chassis of the cleaner for emptying. A bottom lid of the dust-collecting chamber is attached by way of a hinge to the remainder of the chamber and the lid can be released by pressing a release button. A ribbed cylindrical filter is fitted inside the dust-collecting chamber and is rotatable within the chamber to encourage the release of dirt which is stored in the chamber.

SUMMARY OF THE INVENTION

The present invention seeks to provide a bagless vacuum cleaner in which collected dirt and dust can be conveniently disposed of.

Accordingly, a first aspect of the present invention provides a collecting chamber for a bagless vacuum cleaner comprising an inlet for receiving a dirt-laden airflow, an air outlet, a collection area for collecting, in use, dirt and dust which has been separated from the airflow and wherein part of the chamber wall in the region of the collection area is a closure member which is movable between a closed position in which the closure member seals the chamber and an open position in which dirt and dust can escape from the collection area, the chamber further comprising releasing means for releasing the closure member from the closed position, the releasing means comprising a manually operable actuating member which is located remotely from the closure member and wherein the releasing means is operable to apply an opening force to the closure member.

The positioning of the manually operable actuating member remote from the closure member has the advantage that the user is spaced from the dust as the dust empties from the separator. The feature of the releasing means applying an opening force to the closure member has the advantage that the closure member reliably opens without a user needing to touch the closure member. This allows an effective, tightly-fitting seal to be fitted to the closure member which, without the assistance of the opening force, would cause the closure member to 'stick' in the closed position.

The term 'bagless' is intended to cover a broad range of vacuum cleaners which have a reusable collecting chamber, and includes, inter alia, cleaners which separate dirt and dust by way of cyclonic, centrifugal or inertial separation.

Preferably the closure member is pivotably attached to the chamber and the releasing means is operable to apply an opening force to the closure member at a position which is spaced from the pivot, thereby providing a strong opening force.

The seal between the closure member and the wall of the chamber can be a tightly-fitting seal which exerts a radially-directed force against the wall of the chamber. An advantage of a radial seal is that the part of the chamber where the seal acts does not need to be widened to form a seat for the seal, which would be the case with an axially-directed seal. Any widening of the base may also cause dirt to settle in this region rather when the collecting chamber is emptied.

It is convenient for the actuating member to be located adjacent a handle for carrying the collecting chamber. This allows a user to carry and empty the collecting chamber with one hand.

Preferably the collecting chamber is removable from a stowed position on a chassis of a vacuum cleaner and the actuating member is inhibited from opening the closure member when the collecting chamber is in the stowed position. This prevents accidental release of the closure member, which may cause dust to escape from the collecting chamber.

Preferably agitating means are provided for agitating dirt held within the collection area, the agitating means being operable by the actuating member. This helps to dislodge any dirt that may have become 'stuck' in the collection area. Also, a user does not need to separately operate the release and the agitating means.

Preferably the closure member is pivotably fixed to the chamber. Also, it is preferable for the pivot to be located on the side of the chamber nearest the user such that the user is shielded from any dust which is released from the chamber.

The collecting chamber preferably comprises a cyclonic separator where dirt-laden air is spun at high speed to centrifugally separate dirt from the airflow but it can be any form of bagless separator where the collecting chamber is reused after it has been emptied.

The collecting chamber can have more than one separation stage. Preferably the collection areas of the first, second (and further) stage separators each lie adjacent the closure member such that all of the collected dirt and dust can be readily emptied from the collecting chamber.

A further aspect of the invention provides a vacuum cleaner incorporating a collecting chamber of the kind described above.

BRIEF DESCRIPTION OF THE DRAWINGS

Embodiments of the invention will now be described, by way of example only, with reference to the accompanying drawings in which.

DETAILED DESCRIPTION OF THE INVENTION

Figure 1:
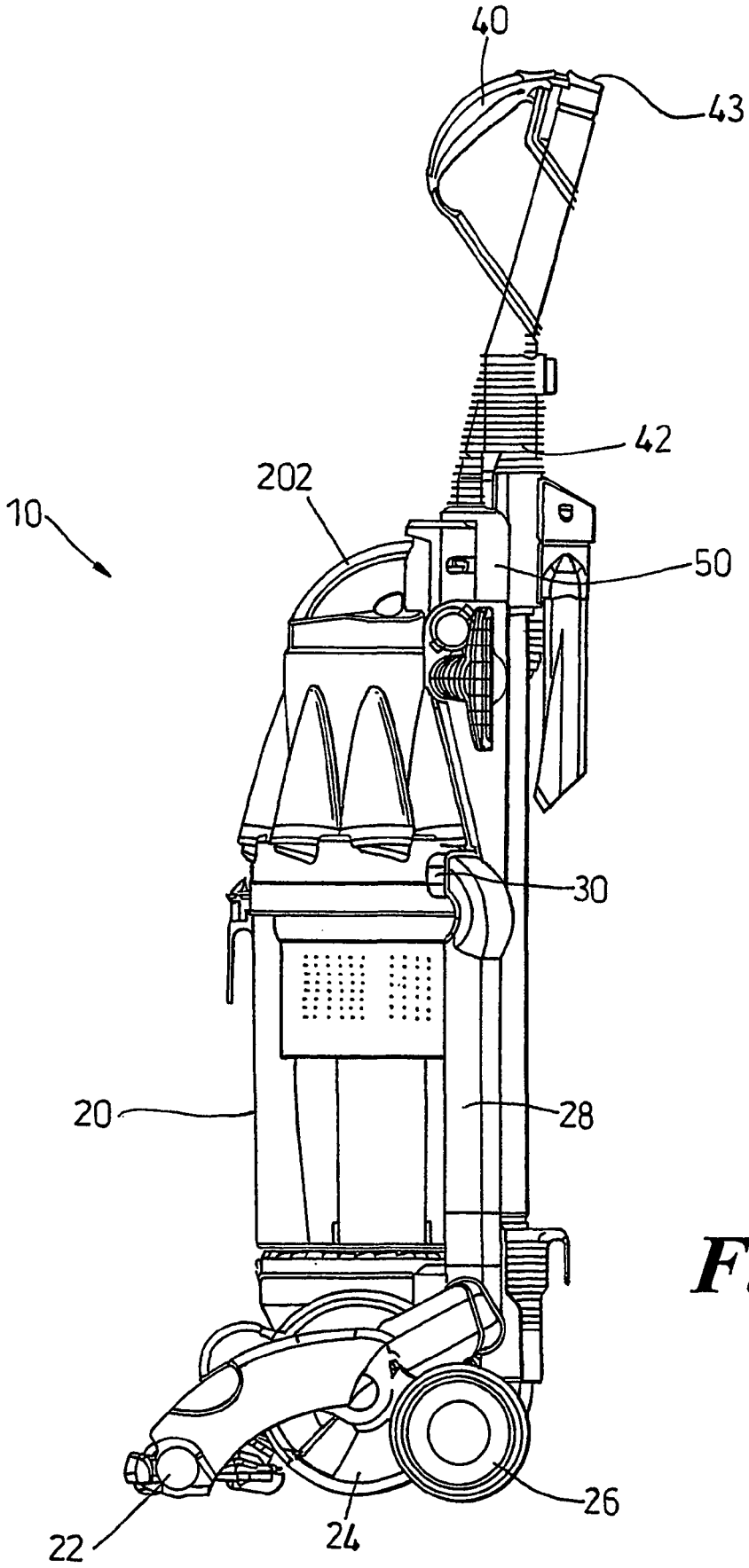
FIG. 1 shows a bagless vacuum cleaner.
Figure 2:
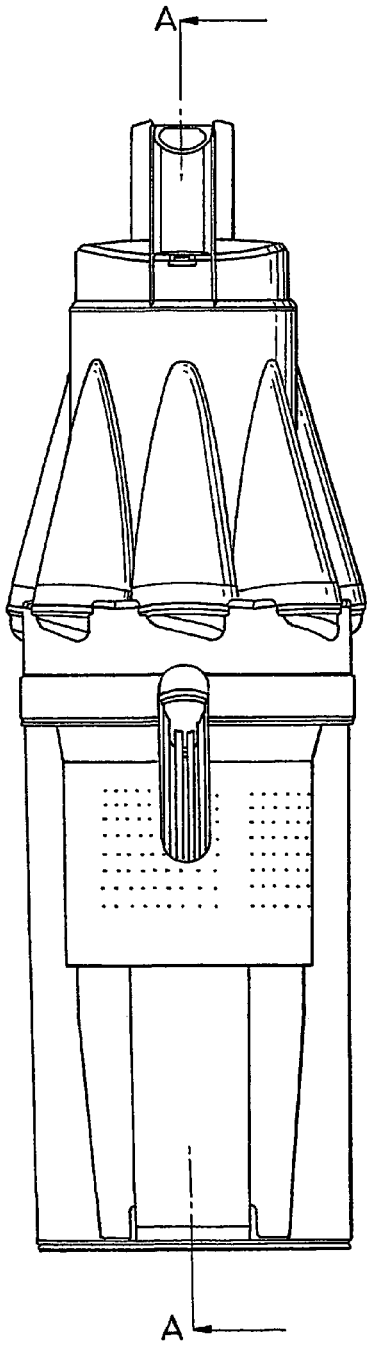
FIG. 2 shows just the dirt and dust separation unit of the vacuum cleaner of FIG. 1.
Figure 3:
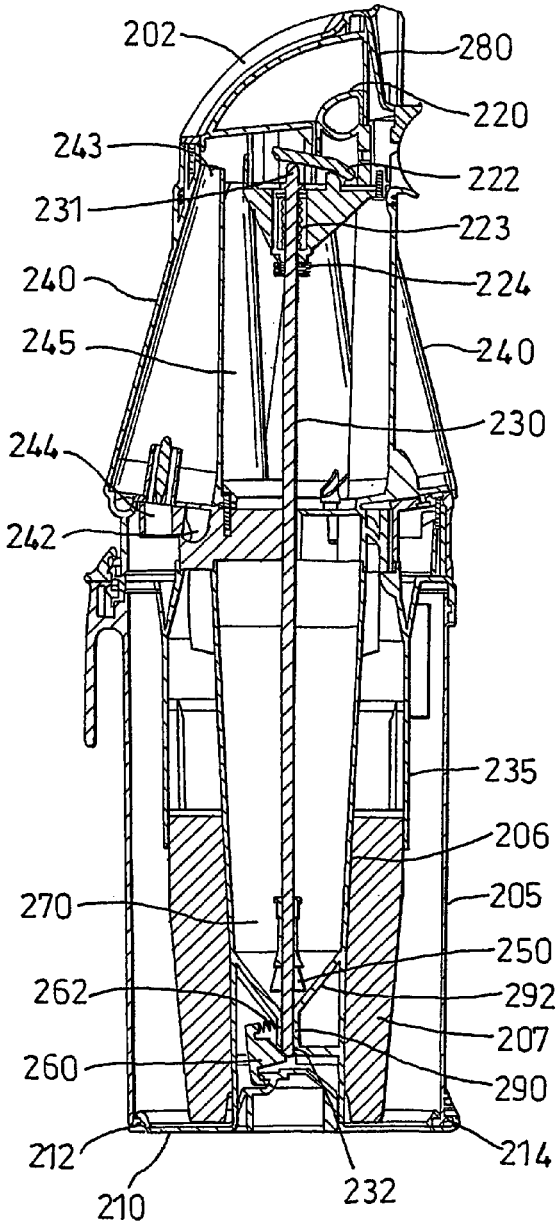
FIG. 3 is a cross-section along line A—A of the dirt and dust separation unit of FIG. 2, with the base of the unit in a closed position.

Referring to FIGS. 1 to 3, a vacuum cleaner 10 has a main chassis 50 which supports dirt and dust separation apparatus 20. The lower part of the cleaner 10 comprises a cleaner head 22 for engaging with the floor surface. The cleaner head has a downwardly facing suction inlet and a brush bar is mounted in the mouth of the inlet for agitating the floor surface. The cleaner head is pivotably mounted to a motor housing 24 which houses the motor and fan of the cleaner. Support wheels 26 are mounted to the motor housing for supporting the cleaner and allowing movement across a floor surface. A spine of the chassis 50 extends upwardly from the motor housing 24 to provide support for the components of the cleaner. A cleaning wand 42 having a second dirty air inlet 43 is connected by way of a hose (not shown) to the chassis at the base of the spine 50. The wand 42 is releasable from the spine 50 so as to allow a user to carry out above-the-floor cleaning and cleaning in places which are inaccessible by the main cleaning head 22. When the wand is fixed to the spine 50, the wand 42 forms the handle of the cleaner and a handgrip 40 at the remote end of the wand 42 allows a user to manoeuvre the cleaner. These features of the cleaner are well known and have been well documented elsewhere and can be seen, for example, in cleaners which are manufactured by DYSON™, and thus will not be described in any further detail.

Dirty air from the cleaner head 22 or wand inlet 43 is carried to the separator unit 20 by inlet conduit 28 and inlet 30. Separator 20 is a cyclonic separator which spins dirt, dust and other debris out of the airflow by centrifugal separation. One particular form of separator unit 20 is shown in detail in the figures as a preferred embodiment but it should be understood that there are many other ways in which the separator could be constructed. In the illustrated separator unit 20, airflow passes through a first separation stage and then a second separation stage. The first separation stage is a substantially cylindrically-walled cyclonic chamber 205 whose purpose is to separate large debris and dirt from the airflow. Inlet 30 is arranged to direct dirty air into the chamber 205 in a tangential direction to the wall of the chamber. Fins or baffles 207 extend radially outwardly from a central core of the chamber and serve to discourage separated dirt or dust from becoming re-entrained in the airflow when the vacuum cleaner is first started. The outlet of the first separation stage is a shroud 235, i.e. an apertured annular wall mounted coaxially inside the chamber 205. The area on the inner side of the shroud leads to the second separation stage. The second separation stage is a set of tapered cyclonic chambers 240 which are arranged in parallel with one another. Each cyclonic chamber 240 has a tangential inlet 242, an outlet 243 for separated dirt and dust and a cleaned air outlet 244. Each of the cleaned air outlets 244 of the cyclonic chambers 240 communicate with an outlet conduit such that air from the individual outlets of the parallel cyclonic chambers is recombined into a single flow. The outlet conduit mates with a port on the chassis spine 50 when the separator unit 20 is fitted to the chassis.

Figure 8:
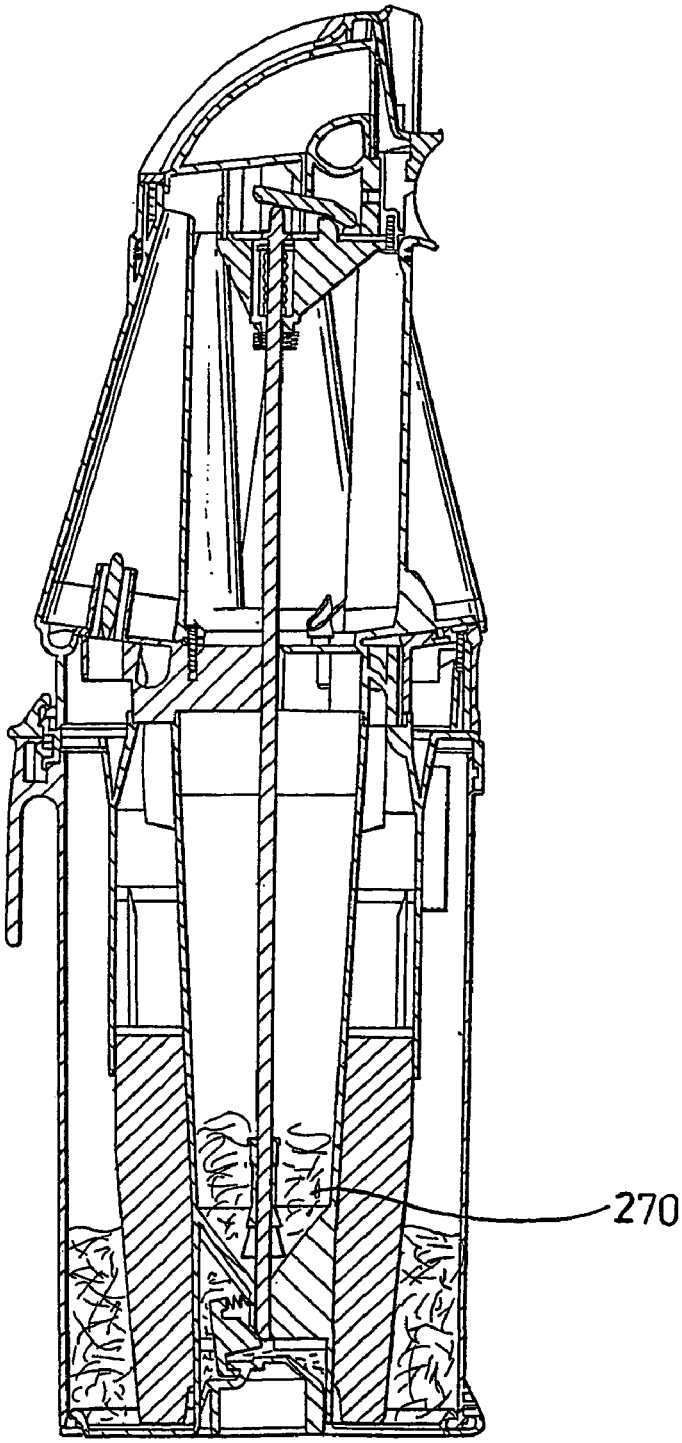
FIG. 8 shows how dirt and dust accumulates in the dirt and dust separation unit, and, FIGS. 9A–9C show the seal of the vacuum cleaner in use.

In use dirty air which is laden with dirt, dust and other debris enters the first separation stage via inlet 30 and follows a spiral path around the chamber 205. The centrifugal force acting on the material in the airflow causes the larger debris and dirt to be separated from the airflow. This separated material collects at the base of the chamber 205, against base 210, due to a combination of gravity and the pressure gradient which exists in chamber 205 while the cleaner is in operation. The airflow passes through the shroud 235. The shroud 235 causes air to perform a sharp change of direction and causes fibrous material to collect on the outer wall of the shroud 235. The airflow passes to the second separation stage where it is divided between the cyclonic chambers. Air enters a respective one of the chambers via a tangential inlet and is then constrained to follow a spiral path of decreasing radius which greatly increases the speed of the airflow. The speed is sufficient to separate dirt and extremely fine dust from the airflow. The separated dirt and dust exits the cyclonic chambers 240 via outlets 243 which communicate with a central conduit 245. Dirt and dust falls, under gravity, towards the base of conduit 245 and collects at the lower end of the conduit 245 adjacent the base 210 in region 270 (FIG. 8). Cleaned air from the parallel chambers 245 is recombined into a single flow and is channelled out of the separator unit 20, down the spine 50 of the chassis and through a pre-motor filter, fan and post-motor filter before finally being exhausted from the cleaner.

It should be understood that the second separation stage need not be a set of parallel cyclonic chambers 240. The second separation stage could be a single tapered cyclonic chamber which can fit inside the cylindrical chamber of the first separation stage, as shown in EP 0 042 723. Alternatively, the second separation stage could be a further cylindrical cyclone or it could be omitted altogether. The first separation stage may be a tapered chamber rather than the cylindrical one described. However, in each of these alternatives, dirt and dust will be separated from an airflow without the use of a filter bag and will collect in a collection area.

Figure 4:
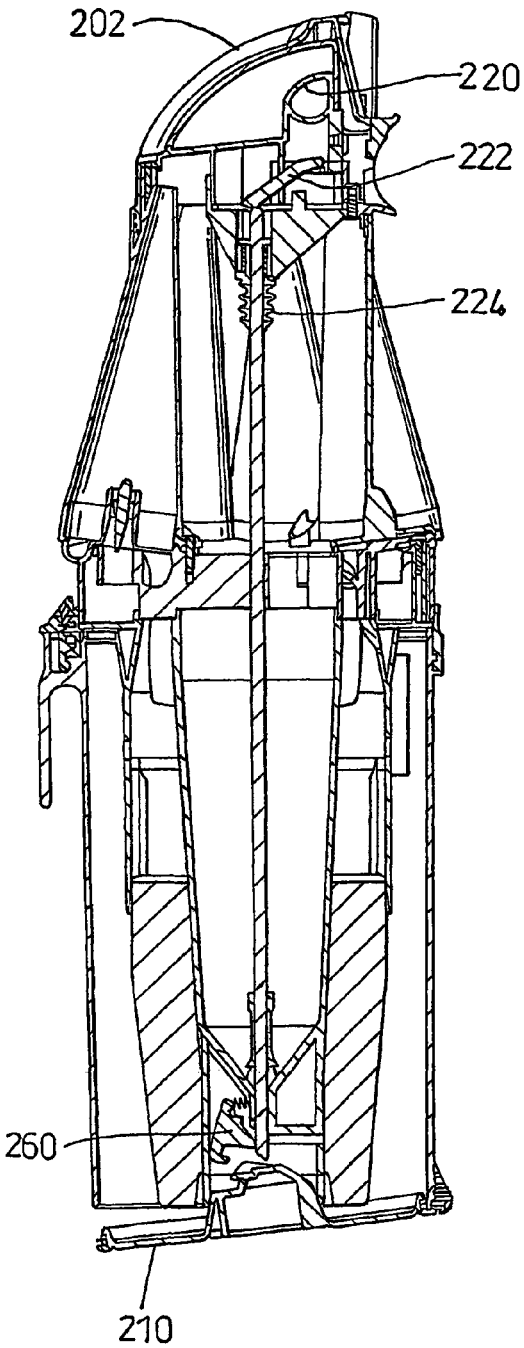
FIG. 4 shows the same cross-section as FIG. 3 but with the base in a partially open position.
Figure 5:
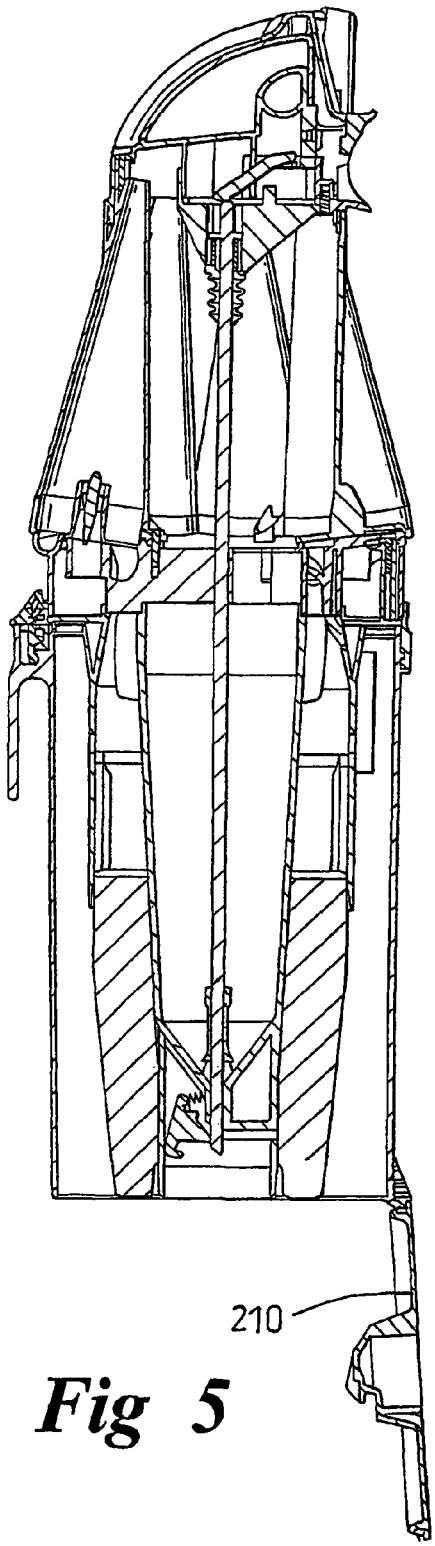
FIG. 5 shows the same cross-section as FIG. 3 but with the base in a fully open position.
Figure 6A:
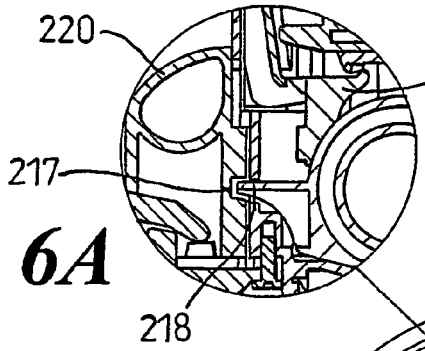
FIG. 6A is a more detailed view of the same cross-section as FIG. 6, showing the feature on the chassis which inhibits movement of the trigger release mechanism.

The separator unit 20 is supported by the chassis 50 and is releasably held upon the chassis by a catch 280, shown more clearly in FIG. 6A. The separator unit 20 is shown by itself in FIGS. 2–5. The separator unit 20 is releasable from the chassis to allow the separator to be emptied. A handle 202 is provided at the top of the separator unit 20 for allowing a user to carry the unit 20. The base 210 of the separator unit is movable between a closed position (shown in FIGS. 2, 3) and an open position (shown partially open in FIG. 4 and fully open in FIG. 5) to permit emptying of the unit 20. The base 210 is hinged at 214 to the cyclone chamber 205 to allow pivotal movement between the base 210 and chamber 205. Two separate collection areas lie adjacent to the base 210. The first collection area is the annular region between the cylindrical chamber wall 205 and the inner wall 206 at the lower end of the separator. The second collection area 270 is the area within the tube-like part 206. Thus, when base 210 opens, material empties from both of the collection areas. The outer annular edge of the base 210 has a radially inwardly extending slot to hold a seal 212. In use, with the base closed, the seal 212 fits tightly against the inner wall of the chamber 205 to maintain an air and dust-tight seal. A second seal 213 extends axially outwardly from the lower annular edge of part 206 such that it fits tightly against the axially extending wall of the raised central cap of the base 210. Seals could be located in other positions to achieve the same sealing effect of the base. The base 210 is held in the closed position by a lock mechanism 260, 262. The locking mechanism is controlled by a manually operable trigger 220. A linking mechanism 222, 223, 224, 230 joins the trigger 220 to the lock mechanism. Trigger 220 is received in a vertically extending channel on the spine-facing side of the separator which confines the trigger to follow a vertical movement. A lug on the trigger cooperates with a lever arm 222. The lever is pivotably fixed to the housing such that the remote end of the lever arm pushes downwardly against the upper end 231 of push rod 230. The push rod 230 is resiliently biased by spring 223 in the position shown in FIG. 3 and can be displaced downwardly (to the position shown in FIG. 4) against the action of the spring 223 when the trigger is pulled. Spring 223 is held in a cavity of the housing and respective ends of the spring 223 act against the end wall of the cavity and the flange which is carried by the push rod 230 near end 231. The linking mechanism is shielded from dust by a gaiter 224, which is attached to the push rod 230 and the housing of the separator unit. The gaiter 224 stretches as the push rod moves downwardly, maintaining a dust-tight shield for the mechanism behind the gaiter 224.

The lowermost end of the push rod has an inclined face which cooperates with a similarly inclined face on the catch 260 at the base. Catch 260 is pivotably mounted to the base and can be displaced, against the bias of spring 262, to the position shown in FIG. 4. The catch has a hook 263 which engages with a corresponding hooked feature 264 on the central part of the base 210 so as to hold the base 210 in the closed position. The lowermost surface of the catch 260 is curved such that when the base 210 is pushed towards the closed position the catch 260 is displaced, allowing the hook 264 on the base 210 to engage with the hook 263 on the catch 260.

It will be appreciated that the trigger, linking mechanism and lock can be realised in many alternative ways. For example, the trigger 220 could be linked directly to the push rod 230, rather than being indirectly linked by the lever 222.

The lower end of the push rod 230 also carries an agitator 250. The agitator 250 is fixed to the push rod and thus moves upwardly and downwardly with the push rod as the trigger 220 is operated. In use, a plug of dirt and dust may form at the lower end of the second collection area, next to base 210. The agitator 250 has radially outwardly extending fins. In use, movement of the agitator will either push the plug or break the plug into smaller parts which can then fall out of the collection area. The inner surfaces of the collection tube are smooth and tapered to discourage dirt from settling. The agitator could be more elaborate than the one shown here. For example, the agitator could be arranged to rotate about the longitudinal axis of the push rod 230 as the push rod moves upwards or downwards. A second agitator could be provided in the first collection area, the second agitator also being linked to the push rod or release mechanism. The cutting effect of the agitator on a plug of material can be improved by forming sharp or pointed edges on the agitator.

To ensure an air and dust-tight seal around the base, the seal 212 fits tightly against the chamber. This may cause the base to 'stick' in the closed position when the catch 260 is released. The push rod 230 has a sufficient length such that, when it is operated, it moves downwardly towards the catch 260, operates catch 260 and then continues to move towards the base 210, pushing against the base, overcoming the resistance of the seal 212 against the chamber wall 205 and thus pushing the base 210 open.

In use, a user removes the separator unit 20 from the chassis by operating release member 280 and carries the separator unit 20, by way of handle 202, to a dust bin or refuse sack. The lower end of the separator unit is held over or within the dust bin or sack and the trigger 220 is pulled. This causes the base 210 to swing open and dirt, dust and debris which has been collected in the chamber 205 falls out of the unit 20 into the bin. Due to the distance between the handle and base, and the direction in which the dirt falls from the unit 20, a user is not brought into contact with the dirt. As the dirt collects against the part of the chamber which opens, i.e. base 210, the dirt falls out of the chamber 205 with little or no additional effort by a user. Fine dust collected within the second stage collector 270 can be fully cleared by the user operating trigger 220 several times. This will operate agitator 250.

Figure 9A:
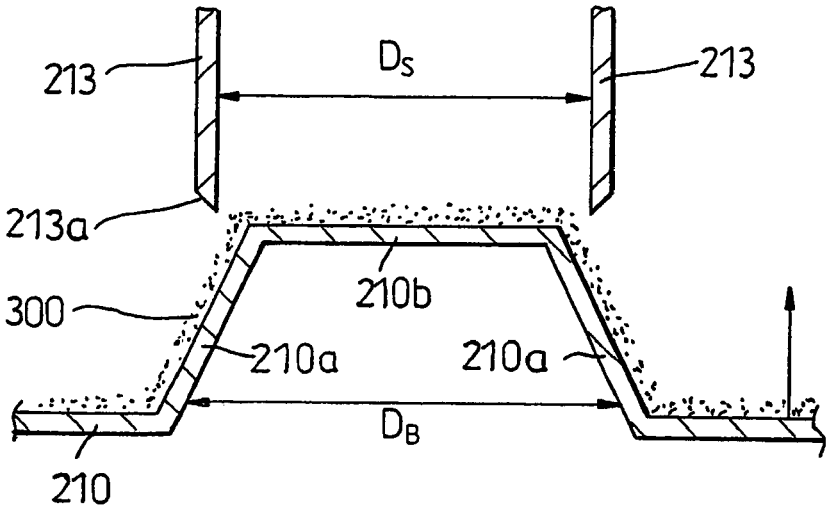
Figure 9B:
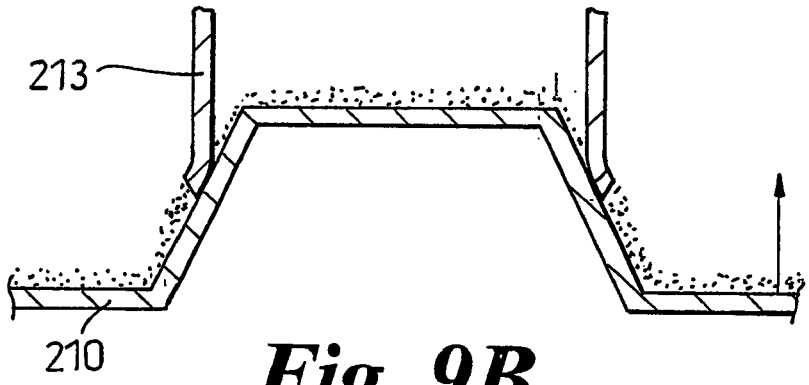
Figure 9C:
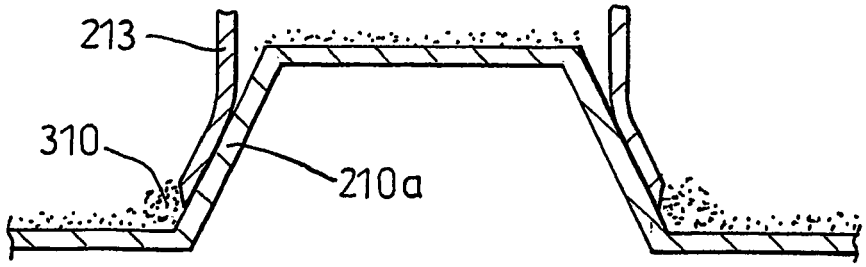

Referring again to FIG. 8, the region within tube-like part 206 forms a second stage collection area. For good cyclonic separation, it is important that the second stage collection area is sealed with respect to the first stage collection area which surrounds it. Collar-shaped seal 213 seals against the base 210 to achieve the seal between the first and second stage collection areas. A particular problem with sealing against the base 210 is that the base is exposed to dirt and dust which can prevent a reliable seal from being achieved. FIGS. 9A–9C show, in more detail, how the seal 213 fits against the base 210 during use.

Base 210 of the separator unit 20 has an inwardly tapering wall 201*a* and an upper wall 210*b*. The collar shaped seal 213 has a diameter $D_S$ which is narrower than the diameter $D_B$ of the base 210 at the position at which the seal lies when the base 210 is fully closed. Seal 213 is formed from a resilient material such as a thermoplastic elastomer (TPE). By arranging for the seal 213 to project outwardly from the end of the tube 206, the seal 213 provides no ledges on which fine dust can accumulate. The annular shape of the seal 213 helps to maintain the shape of the seal, even though it is only supported from the uppermost edge.

FIG. 9A–9C show the base 210 being returned to a closed position against the chamber 205 after a user has emptied the chamber 205. In FIG. 9A it can be seen that a layer of fine dust 300 covers the base 210. In FIG. 9B the base 210 has been moved nearer to its final, closed, position. The lower end of seal 213 has stretched to accommodate wall 210*a* of the base 210. Due to the tight fit between the leading edge 213*a* of the seal 213 and the wall 210*a*, the layer of dust on the outermost surface of the wall 210*a* is pushed downwardly by the leading edge 213*a* of the seal 213. Finally, FIG. 9C shows the base 210 in a closed position. The seal 213 has moved further down the wall 210*a* of the base. A significant portion of the seal 213 now lies firmly against a portion of the wall 210*a* which has previously been cleaned by the leading edge of the seal 213*a*. Dust which has been displaced from the surface of the wall 210*a* accumulates 310 beneath the leading edge 213*a* of seal 213. Thus, a reliable seal is achieved between seal 213 and base 210 even in the presence of dirt and dust.

Figure 6:
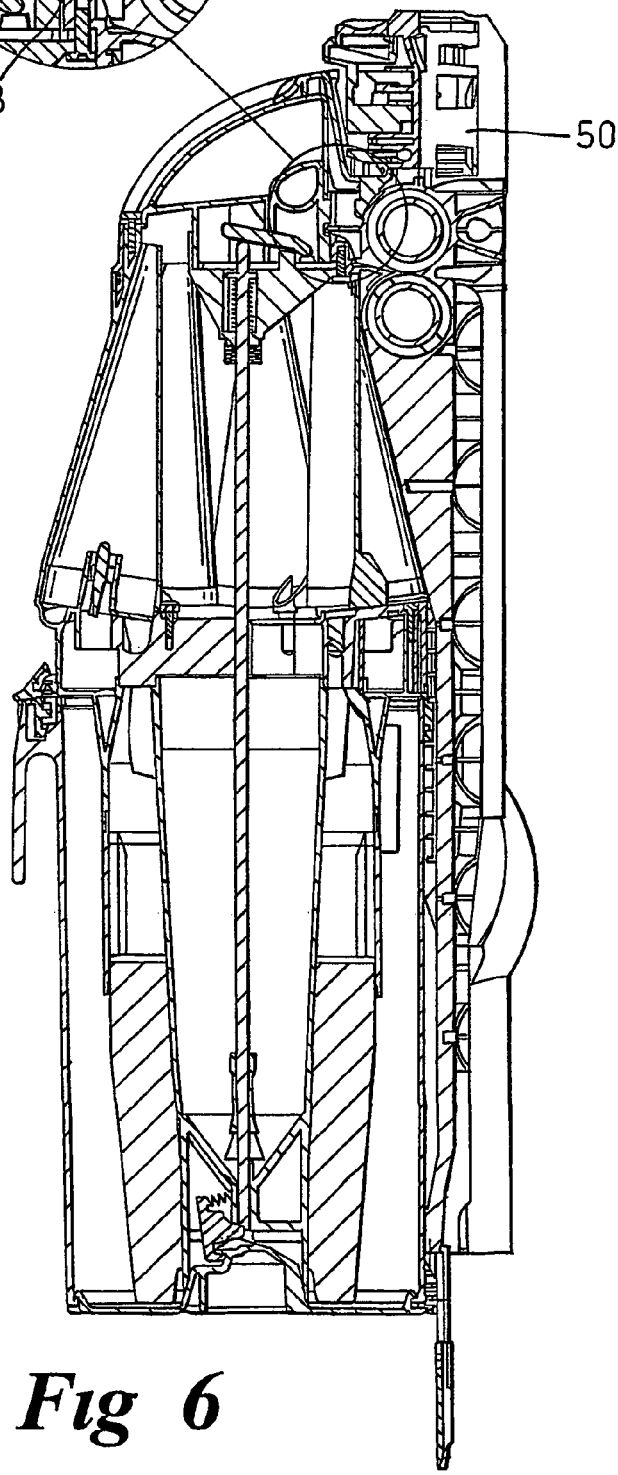
FIG. 6 is a cross-section through the dirt and dust separation unit mounted on the chassis of the vacuum cleaner.
Figure 7:
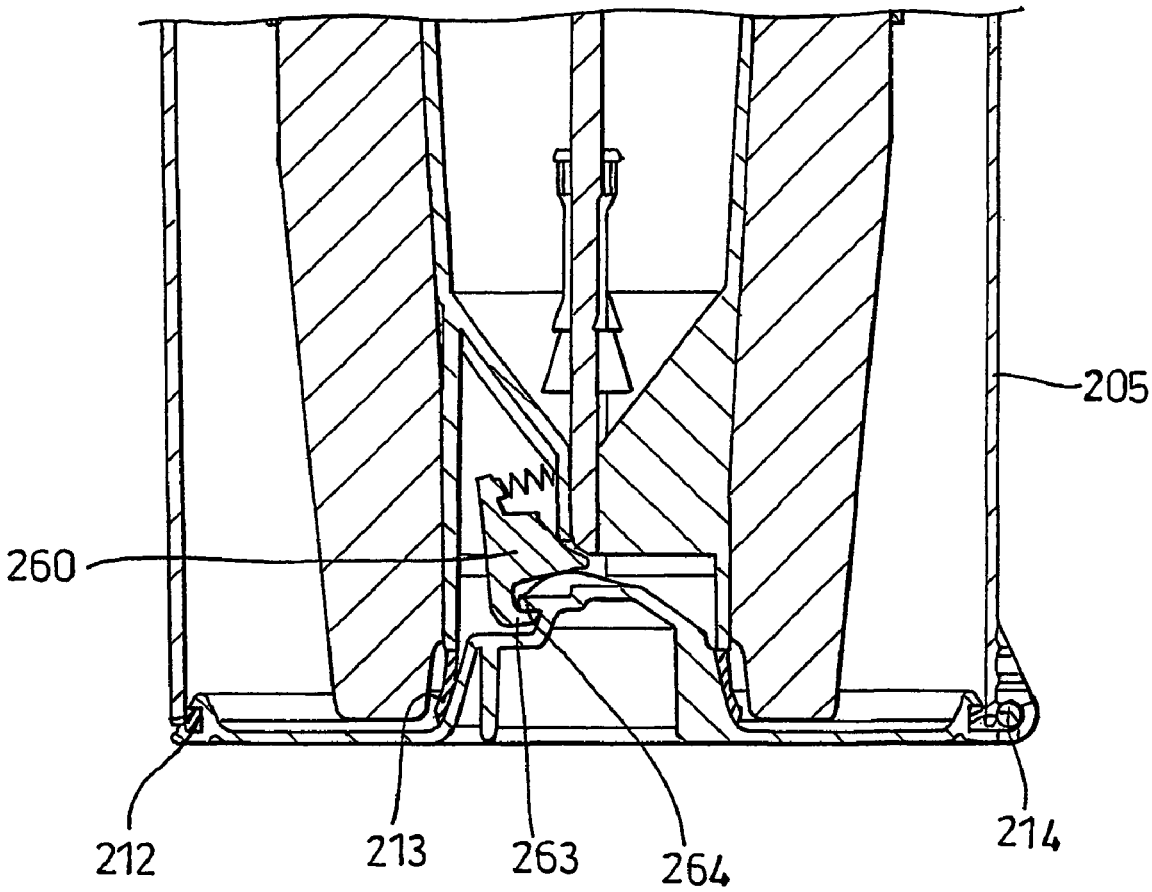
FIG. 7 is a more detailed view of the lower part of the cross-section of FIG. 3.

FIG. 6 shows the separator unit 20 in position on the chassis 50 of the cleaner 10. To ensure that the base 210 is not accidentally opened when the cleaner is in use, the chassis 50 has a projection 218 which fits inside a notch 217 on the trigger 220 when the separator unit 20 is fitted to the chassis 50. Thus, the trigger 220 is inhibited from operating.

What is claimed is:

1. A bagless vacuum cleaner, comprising a walled collecting chamber, a cleaner head, an inlet for receiving a dirt-laden airflow from the cleaner head, an air outlet and a collection area for collecting dirt and dust which has been separated from the airflow, wherein part of the chamber wall in the region of the collection area comprises a closure member which is movable between a closed position in which the closure member seals the chamber and an open position in which dirt and dust can escape from the collection area, the chamber further comprising a releasing mechanism for releasing the closure member from the closed position, wherein the releasing mechanism comprises a manually operable actuating member which is located remotely from the closure member and wherein the releasing mechanism is operable to apply an opening force to the closure member.

2. A bagless vacuum cleaner according to claim 1, wherein the closure member is pivotably attached to the chamber and the releasing mechanism is operable to apply an opening force to the closure member at a position which is spaced from the pivot.

3. A bagless vacuum cleaner according to claim 2, wherein the releasing mechanism is configured to apply an opening force to the center of the closure member.

4. A bagless vacuum cleaner according to claim 1, 2 or 3, wherein the closure member carries a seal for sealing against the part of the collection area in which it is fitted.

5. A bagless vacuum cleaner according to claim 4 wherein the seal exerts a radially-directed force against the wall of the chamber.

6. A bagless vacuum cleaner according to claim 1, 2 or 3, wherein the releasing mechanism comprises a lock for locking the closure member in the closed position and a push rod which is movable to firstly unlock the closure member and secondly to exert the opening force on the closure member.

7. A bagless vacuum cleaner according to claim 1, 2 or 3, wherein the releasing mechanism comprises a lock for locking the closure member and the closure member is automatically locked as the closure member is moved towards the closed position.

8. A bagless vacuum cleaner according to claim 7, wherein the lock is resiliently mounted such that it can be temporarily displaced by the closure member as the closure member is moved toward the closed position.

9. A bagless vacuum cleaner according to claim 1, 2 or 3, further comprising an agitator for agitating dirt held within the collection area, the agitator being operable by the actuating member.

10. A bagless vacuum cleaner according to claim 9, further comprising a linking mechanism that couples the actuating member to the closure member and wherein the agitator is mounted on the linking mechanism.

11. A bagless vacuum cleaner according to claim 1, 2 or 3, wherein the actuating member is located at an opposite end of the collecting chamber to where the closure member is located.

12. A bagless vacuum cleaner, comprising a walled collecting chamber, an inlet for receiving a dirt-laden airflow, an air outlet and a collection area for collecting dirt and dust which has been separated from the airflow, wherein part of the chamber wall in the region of the collection area comprises a closure member which is movable between a closed position in which the closure member seals the chamber and an open position in which dirt and dust can escape from the collection area, the chamber further comprising a releasing mechanism for releasing the closure member from the closed position, wherein the releasing mechanism comprises a manually operable actuating member which is located remotely from the closure member and wherein the releasing mechanism is operable to apply an opening force to the closure member, and further comprising a handle for carrying the collecting chamber and wherein the actuating member is located adjacent the handle.

13. A bagless vacuum cleaner according to claim 12, wherein the actuating member is a trigger mechanism which is located beneath the handle.

14. A bagless vacuum cleaner according to claim 1, 2 or 3, wherein the collecting chamber is configured to be removable from a stowed position on a chassis of the vacuum cleaner and the actuating member is inhibited from opening the closure member when the collecting chamber is in the stowed position.

15. A bagless vacuum cleaner according to claim 1, 2 or 3, wherein the closure member comprises a surface against which dirt and dust can collect during operation of the cleaner.

16. A bagless vacuum cleaner according to claim 15, wherein the closure member forms a base of the collecting chamber.

17. A bagless vacuum cleaner according to claim 1, 2 or 3, wherein the collecting chamber comprises a cyclonic separator.

18. A bagless vacuum cleaner according to claim 4, further comprising an agitator for agitating dirt held within the collection area, the agitator being operable by the actuating member.

19. A bagless vacuum cleaner according to claim 6, further comprising an agitator for agitating dirt held within the collection area, the agitator being operable by the actuating member.

20. A bagless vacuum cleaner according to claim 7, further comprising an agitator for agitating dirt held within the collection area, the agitator being operable by the actuating member.

21. A bagless vacuum cleaner according to claim 8, further comprising an agitator for agitating dirt held within the collection area, the agitator being operable by the actuating member.

22. A bagless vacuum cleaner, comprising a walled collecting chamber comprising a cyclonic separator, an inlet for receiving a dirt-laden airflow, an air outlet and a collection area for collecting dirt and dust which has been separated from the airflow, wherein part of the chamber wall in the region of the collection area comprises a closure member which is movable between a closed position in which the closure member seals the chamber and an open position in which dirt and dust can escape from the collection area, the chamber further comprising a releasing mechanism for releasing the closure member from the closed position, wherein the releasing mechanism comprises a manually operable actuating member which is located remotely from the closure member and wherein the releasing mechanism is operable to apply an opening force to the closure member, and further comprising a second stage separator and a second stage collection area, and wherein both the second stage and first stage collection areas lie adjacent the closure member.

23. A bagless vacuum cleaner according to claim 22, wherein the second stage collection area lies within the first stage collection area.

24. A bagless vacuum cleaner according to claim 23, further comprising a wall which separates the second stage collection area from the first stage collection area.

* * * * *

UNITED STATES PATENT AND TRADEMARK OFFICE

CERTIFICATE OF CORRECTION

PATENT NO. : 6,991,666 B2
APPLICATION NO. : 10/468676
DATED : January 31, 2006
INVENTOR(S) : Stephen P. Organ It is certified that error appears in the above-identified patent and that said Letters Patent is hereby corrected as shown below:

On Title Page item 73

Under Assignee:

Please delete "Dyson Limited" and replace with --Dyson Technology Limited--

Signed and Sealed this

Twenty-ninth Day of May, 2007

JON W. DUDAS
*Director of the United States Patent and Trademark Office*